United States Patent [19]

Bicik et al.

[11] 3,993,254

[45] Nov. 23, 1976

[54] AGITATOR MILL

[75] Inventors: Vladislav Bicik, Birsfelden; Jan Kaspar, Muttenz, both of Switzerland

[73] Assignee: Gebruder Netzsch, Maschinenfabrik, Selb/Bayern, Germany

[22] Filed: Sept. 30, 1974

[21] Appl. No.: 510,772

[30] Foreign Application Priority Data

Sept. 28, 1973 Switzerland ..... 13982/73

[52] U.S. Cl. ..... 241/67; 241/69; 241/172

[51] Int. Cl.[2] ..... B02C 17/18

[58] Field of Search ..... 241/66, 67, 172, 69, 241/73, 74, 65, 170.

[56] References Cited

UNITED STATES PATENTS

| | | | |
|---|---|---|---|
| 2,019,454 | 10/1935 | Larsen | 241/172 X |
| 3,202,364 | 8/1965 | Wieland | 241/172 X |
| 3,223,336 | 12/1965 | Wienert | 241/172 |
| 3,539,116 | 11/1970 | Podmore | 241/172 |
| 3,682,399 | 8/1972 | Kaspar et al. | 241/172 X |

*Primary Examiner*—Roy Lake
*Assistant Examiner*—E. F. Desmond
*Attorney, Agent, or Firm*—Karl W. Flocks

[57] ABSTRACT

An agitator mill for grinding suspensions having a grinding container with oblique and radial disks which may be hollow with a cooling fluid passing therethrough by means of the hollow connecting stirring shaft and the cycle for ground material containing said agitator mill.

8 Claims, 10 Drawing Figures

Fig. 8
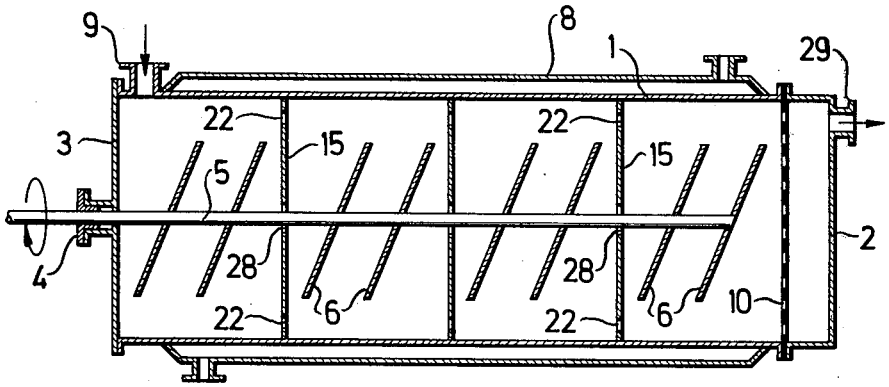
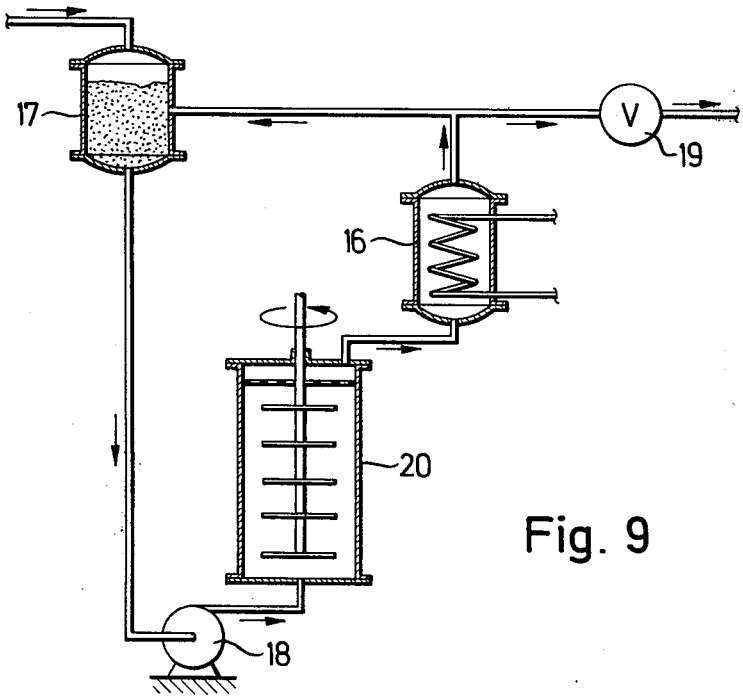
Fig. 9

AGITATOR MILL

BACKGROUND OF THE INVENTION

The invention relates to an agitator mill for continuous or discontinuous grinding dispersion, homogenization and emulsifying of microbial, organic and inorganic suspensions, consisting of a grinding container, comprising a stirrer rotating therein and made of a stirrer shaft and a plurality of stirring disks, freely movable grinding elements and a separation device for separating the ground material from the grinding elements at the outlet from the agitator mill.

Known agitator mills of this kind require operation at relatively high rpm and correspondingly high driving power in order to attain good stirring and grinding effects. The high rpm of the stirrer apparatus leads to high relative velocities between the stirring disks and the material subjected to grinding, owing to which the latter can become highly heated, at least locally. Accordingly, such agitator mills are not very suitable for materials that are sensitive to temperature, e.g., microbial cells.

The invention is based on the task of producing an agitator mill which is suitable in particular for sensitive materials and allows their effective treatment with the materials staying only a short time in the agitator mill.

The problem is solved by proceeding according to the invention from an agitator mill of the type described at the outset, so that oblique disks arranged obliquely on the stirrer shaft are provided as stirring disks.

Oblique disks of this kind exhibit such an intensive grinding and/or stirring effect that a high rpm of the stirrer shaft is not required. Consequently, the ground material is subjected to low mechanical stresses. At the same time, the driving power required for driving the stirrer shaft is reduced. Excessive local temperatures are eliminated.

In addition to a flow-velocity component in the peripheral direction, oblique disks produce a flow component in the axial direction; i.e., parallel to the stirrer shaft, which causes a rotation of the entire contents of the agitator mill and brings about an increased number of collisions between the grinding elements and the ground material. Accordingly, one can thus shorten the time for retaining the ground material in the agitator mill.

Oblique disks possess the additional advantage of being suitable in particular for the employment of very small grinding elements; e.g., those of the diameter of 0.1 to 0.7 mm. Such small and light grinding elements are frequently not actuated sufficiently by the disks in the spaces between ordinary, so-called radial or normal disks arranged perpendicularly to the stirrer shaft. With oblique disks one obtains a better actuation of such small grinding elements that are preferably used for the treatment of microbial substances and the like and, besides, are subjected to a lesser wear than larger grinding elements.

While in the case of radial disks situated perpendicularly on the stirrer shaft, relatively stable flow lines are formed, the employment of oblique disks produces an extensive turbulence, so that the relative displacement between grinding elements and particles of ground material is intensified as desired. When oblique disks of invention are employed, a 4 m/s – 18 m/s peripheral velocity of the stirring disks is sufficient for obtaining very good stirring effects.

SUMMARY OF THE INVENTION

In a preferred embodiment of the invention, mutually adjacent oblique disks are inclined in relation to each other; i.e., they are inclined in opposite direction in relation to the stirrer shaft. The side elevation of a plurality of such reciprocally inclined oblique disks represents a zigzag line or a saw-blade line.

During the rotation of two reciprocally inclined oblique disks in the area of the grinding container where they are situated, such disks effect in alternation a loosening and a compression of the mass of grinding elements, in particular when arranged in a horizontal agitator mill. This produces intensive, semihydraulic flow circulating in the grinding container, which increases the grinding effect.

In many cases, the invention provides a radial disk arranged perpendicularly to the stirrer shaft, in each case between two mutually adjacent oblique disks. Such radial disks may be designated as transverse disks, normal disks, intermediate disks or diaphragm plates.

The diameter of the radial disks is preferably greater than that of the oblique disks and amounts, for example, to 60% – 95% of the diameter of the grinding container.

A particularly advantageous arrangement consists in providing such radial disks on the stirrer shaft of the agitator mill between groups consisting in each case of two reciprocally inclined oblique disks. This produces a distinct, group-type cooperation of stirring disks, owing to which the working space of the grinding container is divided into separate grinding zones. An intermixing of the ground material from the separate grinding zones is avoided through the use of the radial disks and the time-of-stay spectrum of the ground material is improved; i.e. every particle of the ground material possesses approximately the same time of stay in the grinding container. The time of stay can be adjusted in accordance with the diameter of the radial disks, the number thereof and the arrangement and inclination of the oblique disks.

In a modified embodiment of the invention, fixed partitions are arranged in the grinding container between separate stirring disks or between groups consisting of a plurality of stirring disks, the partitions being provided with openings. Also, this divides the interior of the grinding container into separate zones which, among other things, prevents an excessively-fast travel of separate, coarse particles of ground material through the agitator mill in longitudinal direction from the inlet to the outlet. The partitions have an effect which is similar to the series connection of a plurality of separate agitator mills.

Contribution to the solution of the task on which the invention is based is also due to the use of hollow stirring disks which can be traversed by a flow of a cooling agent. With this arrangement, the increased stirring effect obtained with oblique disks can be fully utilized; i.e., one can work with a high driving power of the stirrer shaft without heating the ground material during its movement through the grinding container. One can also treat a very sensitive ground material with a short time of stay in the grinding container.

A cooled embodiment of this kind is provided with a central pipe for the supply of a vaporizable cooling agent, which pipe consists of a hollow shaft, which is connected to cavities of hollow stirring disks and possesses openings for the entry of the cooling agent into the cavities of the hollow stirring disks. The intermediate space between the hollow shaft and the central pipe should be made in this connection such as to serve for discharging possibly a vaporized cooling agent.

Since the heat of vaporization for the cooling agent is derived from the mixture of ground material and grinding elements, one can obtain a very strong cooling of the entire suspension. Through the employment of such a vaporization cooling one reliably avoids any heating of the ground material.

In contrast to this, a further embodiment of the invention is characterized in that the stirrer shaft consists of a hollow shaft that can be subjected to the action of the cooling agent and is connected to the cavities of hollow stirring disks, the cavities of the stirring disks being divided in each case into a feed portion and a discharge portion by a partition provided with openings on its periphery.

A distinct forced flow is obtained with such a purely liquid cooling and the hollow stirring disks are intensively cooled throughout their entire extension.

One can intensify the heat exchange in this connection in such a manner that the hollow stirring disks are provided with uneven partitions having, in particular, a corrugated shape or a multiple outline surface.

Finally, the invention provides the possibility of arranging a cooler for the ground material immediately subsequently to the agitator mill. The agitator mill is connected in such a case into a cycle for ground material consisting of the agitator mill, the cooler, a levelling vessel or the like, and a circulating pump. If sensitive material should actually be discharged in a warmed-up state from the agitator mill, this arrangement allows it to stay at increased temperature only for a short period of time.

A special embodiment of the invention is characterized by the insertion of two agitator mills into two cycles, containing in each case a cooler for the ground material arranged subsequent to the agitator mill, the cycles being connected to a common levelling vessel or the like and a common circulating pump. A required high power can thus be distributed in simple manner to two agitator mills and the cooling of the suspension, which may be required, is thus guaranteed.

Further, the agitator mill may be characterized by a grinding container of a cross section that differs from the circular shape; e.g., an oval or polygonal cross section.

Agitator mills having a non-round cross section of the grinding container are known as such: however, within the scope of the invention one obtains special advantages with such a grinding container. Apparently, the employment of oblique stirring disks provides a possibility of driving the contents of the grinding container in rotation at a greater rate than in the case where only radial disks or other stirring means are employed. In the case of an oval, polygonal or other cross section, partial zones act as flow-disturbing elements, that prevent or modify the rotational flow. This is particularly important in the processing of heavy so-called "short suspension" wherein a sufficient actuation of the grinding elements occurs otherwise under certain circumstances only in the immediate stirring range of the stirring disks.

The described measures are preferably applied to an agitator mill which is characterized by a horizontal or slightly inclined arrangement. The advantages described above then occur to a particularly high extent.

BRIEF DESCRIPTION OF THE DRAWINGS

The invention is explained more in detail in the following text by means of exemplified embodiments that are illustrated in the drawings wherein:

FIG. 8 shows the longitudinal section of another embodiment;

FIG. 9 shows an illustration of an agitator mill connected for cyclic operation.

DESCRIPTION OF THE PREFERRED EMBODIMENTS

Figure 1:
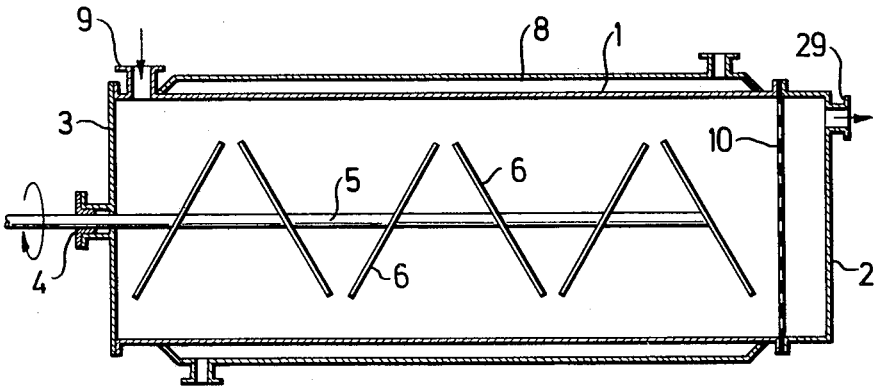
FIG. 1 shows the longitudinal section of a horizontal agitator mill.

According to FIG. 1, a closed horizontal agitator mill for continuous operation is provided with a grinding container 1, which is closed on the faces by lids 2,3. A stirrer shaft 5 is passed through a packing box 4, a slide-ring packing or the like arranged in lid 3, the shaft being mounted here in overhung manner (i.e. it possesses a free end that is not supported).

As stirring disks, one employs a plurality of oblique disks 6 attached on stirrer shaft 5, in which connection mutually adjacent disks are so inclined in relation to each other that their side elevation corresponds approximately to a zigzag line (saw-blade line). The angle at which an oblique disk 6 is inclined to stirrer shaft 5 may be situated between 30° and 85°. In FIG. 1, every oblique disk 6 is inclined at the same angle to stirrer shaft 5, but adjacent oblique disks 6 are turned in each case by 180° on stirrer shaft 5. However, it is possible to incline the disk to a different extent (use different angles).

Grinding container 1 has a double jacket 8, which is employed in known manner for cooling. Grinding container 1 is filled from 50% to 90% with freely movable grinding elements that should have a diameter of 0.1 to 5 mm and may consist of glass, ceramics, synthetic resin, sand or metal. The suspension is supplied through an inlet connection 9, ground and treated during the passage through grinding container 1, separated from grinding elements by means of a screen 10 and discharged through an inlet connection 29.

Figure 2:
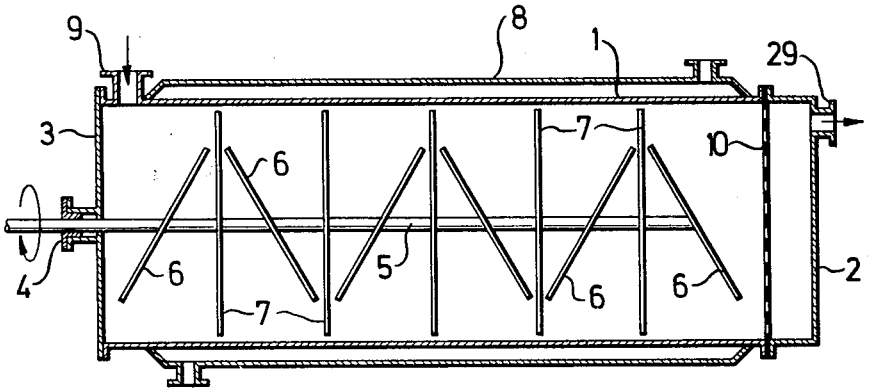
FIG. 2 shows the longitudinal section of another embodiment.

According to FIG. 2, a so-called radial disk 7 is arranged in each case between two adjacent oblique disks 6, which disk 7 is arranged at a right angle to stirrer shaft 5. Oblique disks 6 are here also inclined in alternation to the right and to the left while stirrer shaft 5 is horizontal.

Figure 3:
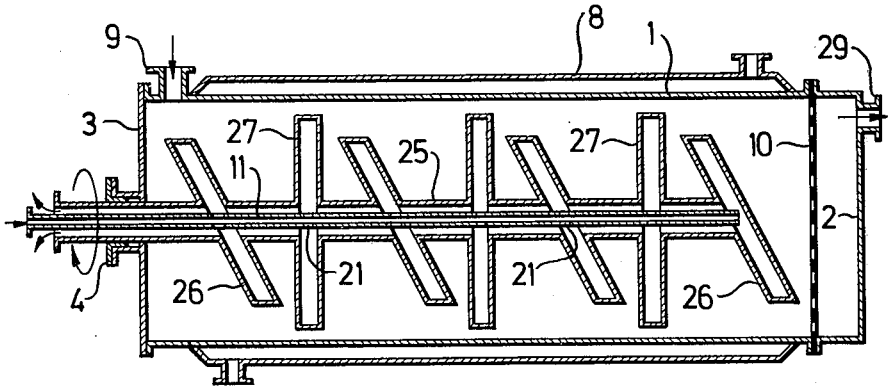
FIG. 3 shows the longitudinal section of another embodiment.

On the other hand, according to FIG. 3, radial disks 27 are arranged between oblique disks 26 on a stirrer shaft that consists of a hollow shaft 25, oblique disks 26 being parallel to each other.

Figure 4:
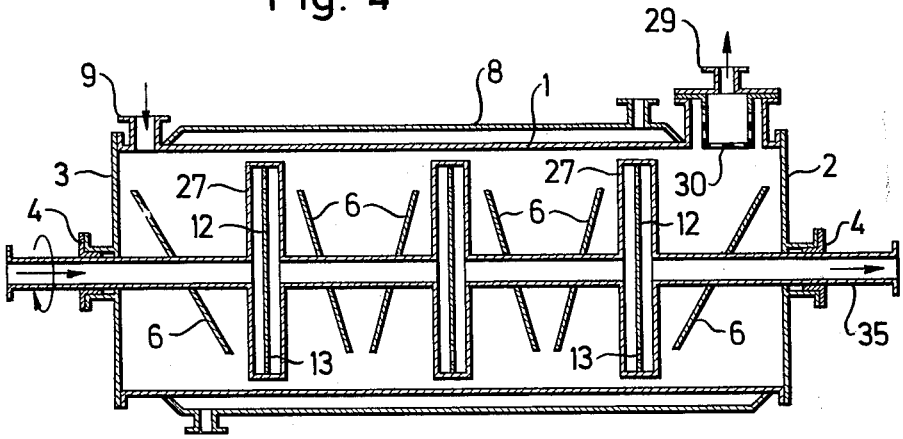
FIG. 4 shows the longitudinal section of another embodiment.
Figure 5:
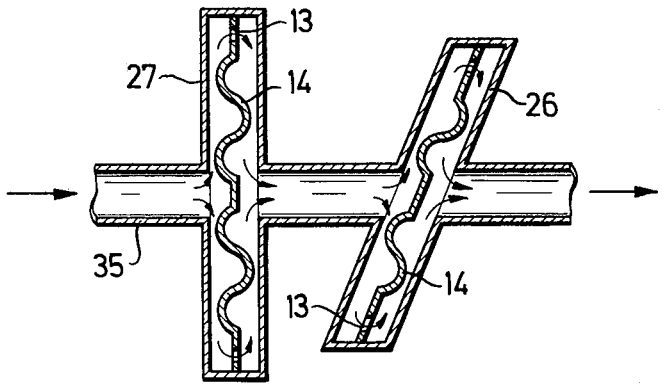
FIG. 5 shows the longitudinal section through the parts of a cooled stirrer apparatus.
Figure 6:
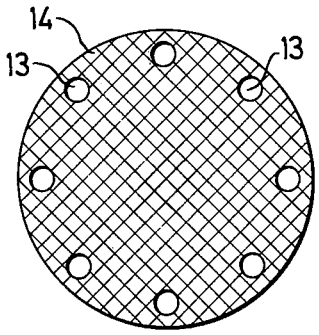
FIG. 6 shows details of a stirring disk.

According to FIG. 4, some oblique disks 6 inclined toward each other are arranged on a stirrer shaft 35 in pairs; i.e., in groups and the groups are separated from each other by radial disks 27. The radial disks subdivide the grinding container in various treatment zones as desired in any case.

According to FIG. 8, a similar zone sub-division is obtained such that fixed partitions 15 are arranged in grinding container 1, in each case, between groups consisting of two oblique disks 6. Partitions 15 possess openings 22 and central openings 28. Openings 22 are employed only for the passage of ground material and grinding elements; central opening 28 is traversed additionally by stirrer shaft 5.

FIGS. 3, 4, 5, and 6 relate to exemplified embodiments of the invention wherein some stirring disks or every stirring disk may be cooled in a special manner. The coolable stirring disks are hollow and may be traversed by the flow of a cooling agent.

According to FIG. 3, the stirrer shaft consists of a hollow shaft 25, wherein a central pipe 11 is arranged. Hollow shaft 25 is connected to the cavities of hollow oblique disks 26 and hollow radial disks 27. Central pipe 11 is provided with openings 21 in the positions where stirring disks are arranged on hollow shaft 25.

The device operates in the following manner. A liquid cooling agent is introduced into central pipe 11 in the direction of the arrow, which agent evaporates when warmed up to a certain extent. It passes through openings 21 into oblique disks 26 and radial disks 27, is thrown outward in the stirring disks through the centrifugal force and evaporated through heating. The heat of vaporization is provided by the ground material and the grinding elements, so that the contents of the grinding container subjected to treatment are cooled to a corresponding extent. The vaporized cooling agent flows back through the intermediate space between hollow shaft 25 and central pipe 11 and is led to a cooling unit that is not illustrated, in order to be liquefied again. A very intensive cooling of the agitator mill can be obtained in this manner.

FIG. 4 shows an agitator mill wherein the stirrer shaft and some stirring disks may be cooled by a cooling liquid that does not vaporize. The stirrer shaft consists of a hollow shaft 35 that does not possess a central pipe; it is passed through two lids 2,3 of the faces of grinding container 1 by means of identical packing boxes 4 and supported on both sides. According to FIG. 4, only radial disks 27 are hollow and provided with a partition 12 sub-dividing each such stirring disk into a feed portion and a discharge portion. Partitions 12 are provided with peripheral openings 13.

The cooling liquid enters at an end of hollow shaft 35, flows through hollow shaft 35 into the feed portion of first radial disk 27, is forced outward, flows through openings 13 into the discharge portion of the radial disk and flows in the same manner through hollow shaft 35 and remaining radial disks 27 until it is discharged at the other side of hollow shaft 35.

Naturally, oblique disks 6 may also be cooled. Also in this case, it is possible to arrange a central pipe in the hollow shaft and to feed and discharge the cooling liquid at the same end or side of the agitator mill.

Moreover, in place of screen 10, FIG. 4 shows a screen separator 30 that may form a unit together with outlet connection 29.

The partitions in hollow, sub-divided stirring disks need not be plane. For example, according to FIG. 5, partitions 14 are corrugated or grooved. According to FIG. 6, the surface of partition 14 is provided with a multiple profile so as to look like a rasp or a coarse file. Preferably, the uneven feature is such that there obtains a uniform flow from inside toward the outside in the feed portion and from the outside inward in the discharge portion of the cooled stirring disk. One strives to obtain a strongly turbulent flow in this connection, in order to increase suitably the heat exchange. It is also possible to provide uneven features on the inner side of the external walls of hollow stirring disks; i.e., to "profile" such inner side, in order to intensify the cooling.

FIG. 9 illustrates the connection of an agitator mill which is inserted into the cycle for a portion of the ground material. An agitator mill 20, illustrated in this case as a vertical agitator mill, is followed directly by a cooler 16 for the ground material, so that the heated ground material is subjected to increased temperature only for a very short time. From cooler 16, the cycled ground material passes into a levelling vessel 17, from there into a circulation pump 18 and from there again into stirrer mill 20. Fresh material subjected to grinding is fed into the levelling vessel and the fully ground material is removed from the cycle by means of a regulating valve 19.

Figure 10:
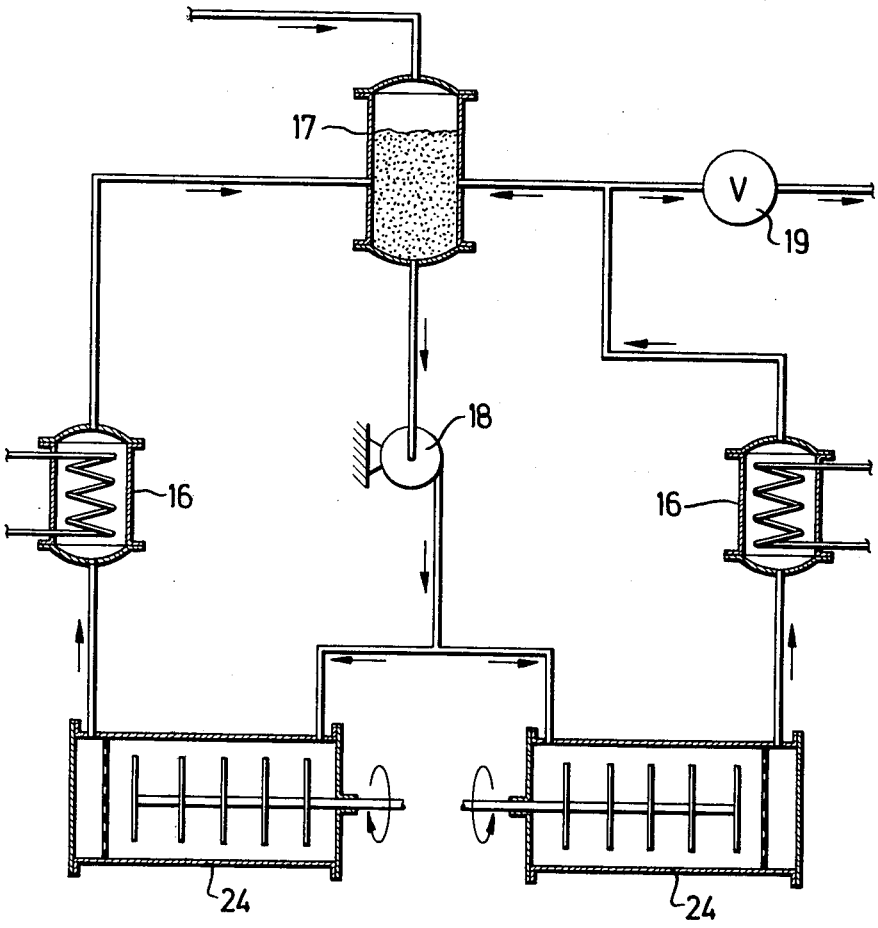
FIG. 10 shows an illustration of two agitator mills connected for cyclic operation.

According to FIG. 10, two cycles provided with coolers 16 and containing agitator mills 24 are connected in similar manner to a common levelling vessel 17 and a common circulating pump 18. A corresponding suitable increase of output can be obtained in this manner.

Figure 7:
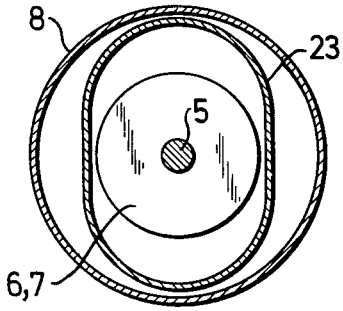
FIG. 7 shows the cross section of an agitator mill having an oval grinding container.

Finally, FIG. 7 shows an example of a grinding container that differs in cross section from the circular shape; a grinding container 23 in schematic cross section, which possesses an oval shape. Also, grinding containers comprising a triangular shape may be considered.

The grinding container consisting of metal may be lined with an inner layer of synthetic rubber, enamel or ceramic material.

It will be obvious to those skilled in the art that various changes may be made without departing from the scope of the invention and the invention is not to be considered limited to what is shown in the drawings and described in the specification.

What is claimed is:

1. An agitator mill for continuous or discontinuous grinding, dispersion, homogenization and emulsifying of microbial organic and inorganic suspension material, comprising a grinding container having an inlet and an outlet for the material to be ground and including a stirrer shaft rotating therein having a plurality of stirring disks mounted thereon, freely movable grinding elements, and a separation device for separating the ground material from said grinding elements at said outlet from the agitator mill, said stirring disks comprising oblique disks arranged obliquely on said stirrer shaft and radial disks arranged perpendicularly to said stirrer shaft between said oblique disks.

2. The agitator mill as in claim 1 in which a radial disk is arranged on said stirrer shaft in each case between two mutually-adjacent oblique disks.

3. The agitator mill as in claim 1 in which a radial disk is arranged on said stirrer shaft between groups consisting in each case of two of said oblique disks inclined in relation to each other.

4. The agitator mill as in claim 1 in which said grinding container has a cross section transverse to said stirrer shaft that differs from the circular shape.

5. An agitator mill for continuous or discontinuous grinding, dispersion, homogenization and emulsifying of microbial, organic and inorganic suspension material, comprising a grinding container having an inlet and an outlet for the material to be ground and including a stirrer shaft rotating therein having a plurality of stirring disks mounted thereon, freely movable grinding elements, and a separation device for separating the ground material from said grinding elements at said outlet from the agitator mill, said stirring disks comprising oblique disks arranged obliquely on said stirrer shaft and being hollow for transversing by a cooling agent.

6. An agitator mill as in claim 5, further characterized by a central pipe arranged for the supply of vaporizable cooling agent in said stirrer shaft, including a hollow shaft and connected to the cavities of said hollow stirring disks, said pipe having openings for the passage of the cooling agent into the cavities of said hollow stirring disks, an intermediate passage between said hollow shaft and said central pipe being made such as to serve for the discharge of the cooling agent.

7. An agitator mill as in claim 5, further characterized by said stirrer shaft including a hollow shaft that can be subjected to the action of a cooling agent and is connected to cavities of said hollow stirring disks in which connection the cavities said stirring disks are divided into a feed portion and a discharge portion in each case by a partition that is provided with openings on its periphery.

8. An agitator mill as in claim 7, further characterized by said partitions in said hollow stirring disks being uneven; in particular, being corrugated or provided with a multiple-outline surface.

* * * * *